US009781956B2

(12) United States Patent
Carmack

(10) Patent No.: US 9,781,956 B2
(45) Date of Patent: Oct. 10, 2017

(54) BODILY PROTECTION ASSEMBLY

(71) Applicant: William Carmack, Verona, PA (US)

(72) Inventor: William Carmack, Verona, PA (US)

( * ) Notice: Subject to any disclaimer, the term of this patent is extended or adjusted under 35 U.S.C. 154(b) by 416 days.

(21) Appl. No.: 14/504,607

(22) Filed: Oct. 2, 2014

(65) Prior Publication Data

US 2016/0095361 A1 Apr. 7, 2016

(51) Int. Cl.
*A41D 13/00* (2006.01)
*A41D 13/05* (2006.01)
*A63B 71/08* (2006.01)

(52) U.S. Cl.
CPC ..... *A41D 13/0512* (2013.01); *A63B 71/08* (2013.01); *A41D 13/0518* (2013.01)

(58) Field of Classification Search
CPC .... A63B 71/08; A63B 71/12; A41D 13/0512; A41D 13/0518
See application file for complete search history.

(56) References Cited

U.S. PATENT DOCUMENTS 553,546 A * 1/1896 Taylor ..... A41D 13/0518 2/267
690,140 A * 12/1901 Gamble ..... A41D 13/0518 2/463
1,253,260 A * 1/1918 Levinson ..... A63B 71/12 2/16
1,600,410 A * 9/1926 Hartman ..... A63B 71/12 2/267
1,657,866 A * 1/1928 Mooney ..... A63B 71/081 2/462
2,756,429 A * 7/1956 Malachowski ..... A63B 71/12 2/461
3,398,406 A * 8/1968 Waterbury ..... B63C 9/087 2/2.5
3,945,042 A * 3/1976 Lobo ..... A41D 13/0156 2/16
4,194,501 A * 3/1980 Watt ..... A61F 5/055 128/DIG. 20
4,449,251 A 5/1984 Gauthier
4,989,265 A 2/1991 Nipper et al.
5,048,125 A * 9/1991 Libertini ..... A63B 21/065 2/79
5,226,192 A 7/1993 Jones et al.
5,272,770 A * 12/1993 Allen ..... A42B 3/0473 2/421
5,297,293 A * 3/1994 Obujen ..... A41D 13/0156 2/267
5,337,418 A * 8/1994 Kato ..... A41D 13/0156 2/44
5,353,437 A * 10/1994 Field ..... A41D 13/0153 2/421

(Continued)

*Primary Examiner* — Richale Quinn

(57) ABSTRACT

A bodily protection assembly for protecting a user from impact energy includes a pair of shoulder pads structured to be worn by the user. A top cage is coupled to the shoulder pads such that the top cage is positioned between the shoulder pads and the user's shoulders. Thus, the top cage may prevent impact energy from being transferred into the user's shoulders. A lower cage is coupled to the shoulder pads such that the lower cage is positioned between the shoulder pads and the user's upper torso. The lower cage surrounds the user's upper torso. Thus, the lower cage may prevent impact energy from being transferred into the user's upper torso.

6 Claims, 4 Drawing Sheets

(56) References Cited

U.S. PATENT DOCUMENTS 5,410,755 A * 5/1995 Obujen ..... A41D 13/0156 2/267
5,517,699 A * 5/1996 Abraham, II ..... A41D 13/0512 2/205
5,524,641 A * 6/1996 Battaglia ..... A41D 13/0153 128/846
5,530,966 A 7/1996 West
5,579,538 A 12/1996 Brunty
5,671,699 A * 9/1997 Forbes ..... A62B 35/0006 119/857
5,987,654 A * 11/1999 Chartrand ..... A63B 71/12 2/462
6,006,368 A * 12/1999 Phillips ..... A42B 3/0473 2/421
6,094,743 A * 8/2000 Delgado ..... A41D 13/08 2/16
6,962,572 B1 * 11/2005 Zahiri ..... A61F 5/028 128/869
8,327,463 B2 12/2012 Udelhofen
8,393,017 B2 * 3/2013 Sheren ..... A41D 13/0512 2/425
8,904,915 B2 * 12/2014 Howland ..... F41H 1/02 89/36.05
2001/0034498 A1 * 10/2001 Heyman ..... A61F 5/03 602/19
2002/0162162 A1 * 11/2002 Collins ..... A41D 13/0158 2/463
2003/0167560 A1 * 9/2003 LaShoto ..... A41D 13/015 2/463
2005/0210569 A1 * 9/2005 Panzenbock ..... A41D 13/015 2/463
2006/0053526 A1 * 3/2006 Beland ..... A41D 13/0015 2/115
2006/0101553 A1 * 5/2006 Aspray ..... A41D 13/015 2/69
2007/0151004 A1 * 7/2007 Brassill ..... A63B 71/12 2/461
2008/0250552 A1 * 10/2008 Durham ..... A41D 13/0153 2/456
2011/0072567 A1 * 3/2011 Duhame ..... A41D 13/015 2/466
2012/0278980 A1 11/2012 Chuback
2014/0020161 A1 * 1/2014 Mason ..... A41D 13/015 2/462
2014/0289938 A1 * 10/2014 Brown ..... A41D 13/015 2/455
2014/0298574 A1 * 10/2014 Williams ..... A41D 13/0512 2/459

* cited by examiner

BODILY PROTECTION ASSEMBLY

BACKGROUND OF THE DISCLOSURE

Field of the Disclosure

The disclosure relates to protection devices and more particularly pertains to a new protection device for protecting a user from impact energy.

SUMMARY OF THE DISCLOSURE

An embodiment of the disclosure meets the needs presented above by generally comprising a pair of shoulder pads structured to be worn by a user. A top cage is coupled to the shoulder pads such that the top cage is positioned between the shoulder pads and the user's shoulders. Thus, the top cage may prevent impact energy from being transferred into the user's shoulders. A lower cage is coupled to the shoulder pads such that the lower cage is positioned between the shoulder pads and the user's upper torso. The lower cage surrounds the user's upper torso. Thus, the lower cage may prevent impact energy from being transferred into the user's upper torso.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
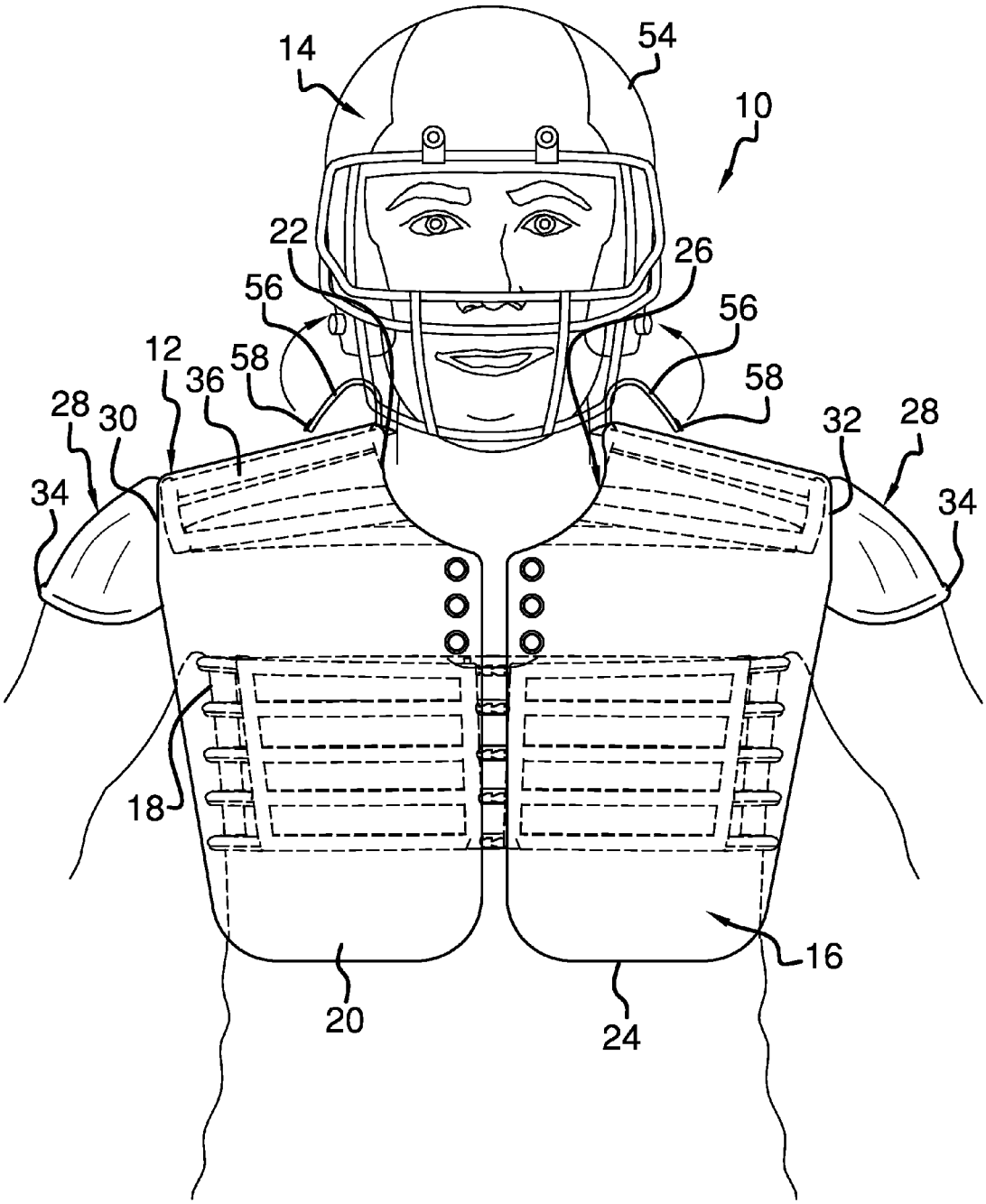
FIG. 1 is an in-use of a bodily protection assembly according to an embodiment of the disclosure.
Figure 2:
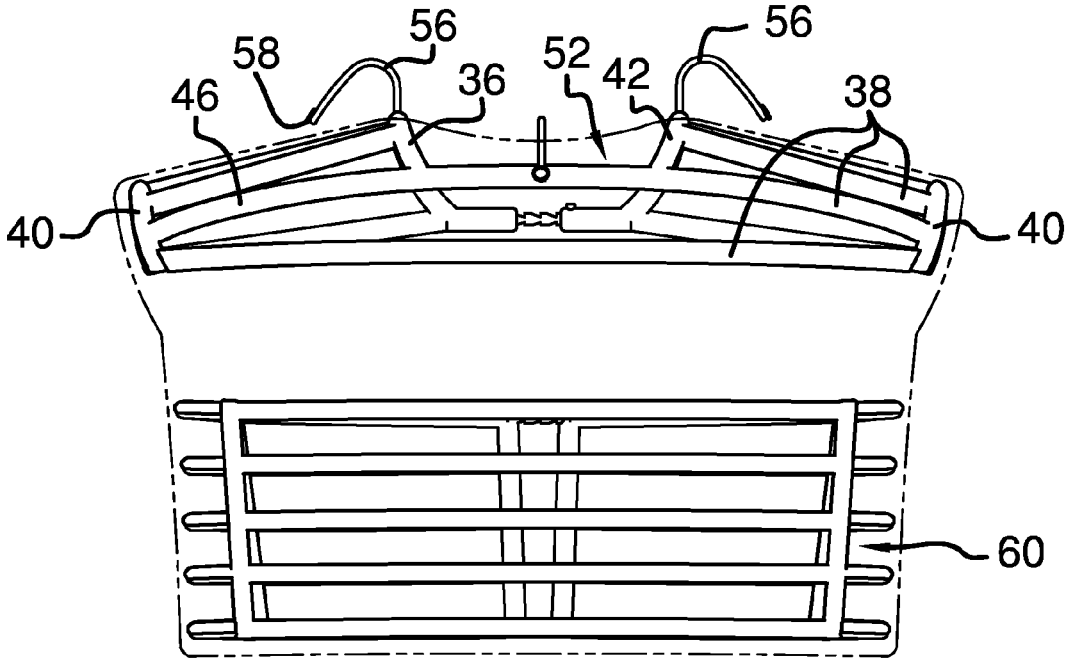
FIG. 2 is a back view of an embodiment of the disclosure.
Figure 3:
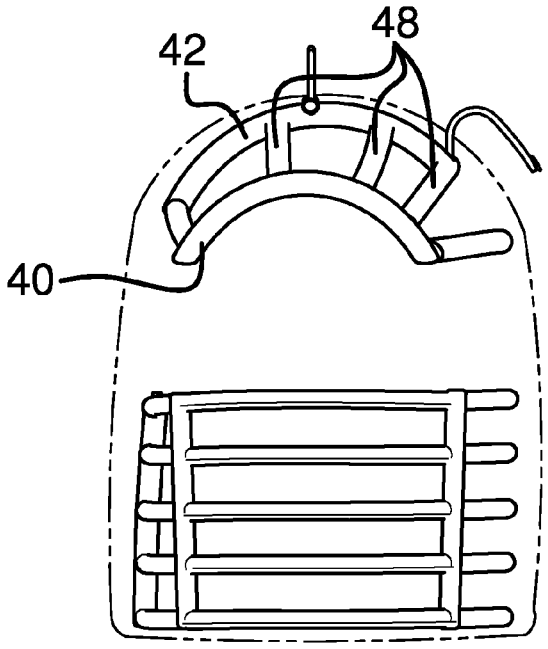
FIG. 3 is a left side view of an embodiment of the disclosure.
Figure 4:
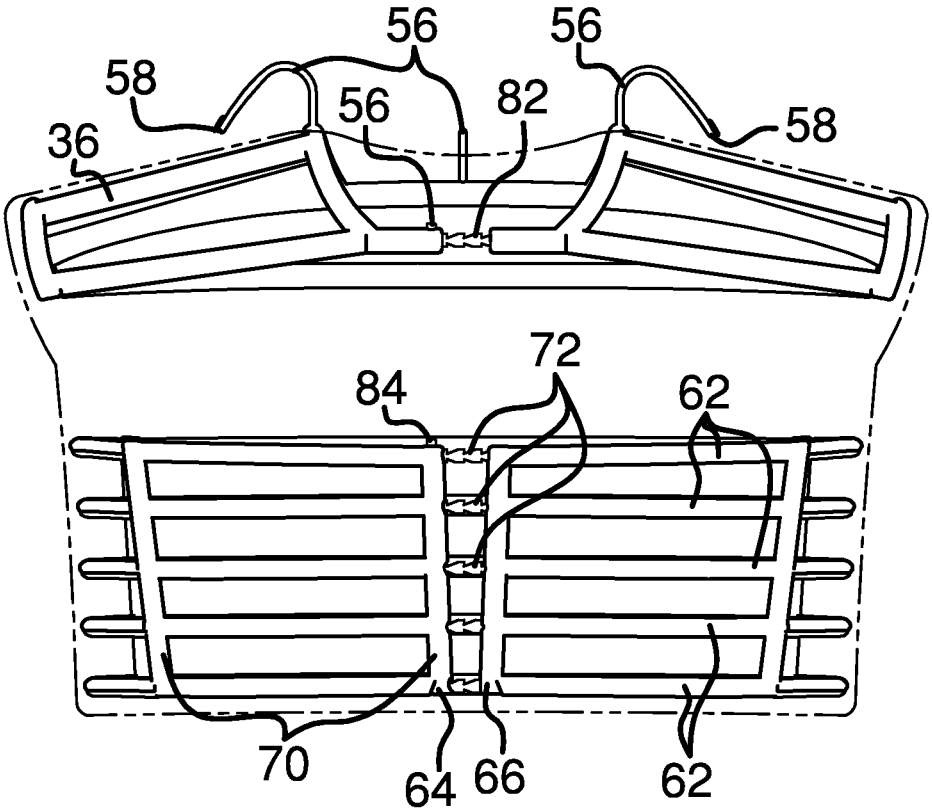
FIG. 4 is a front view of an embodiment of the disclosure.
Figure 5:
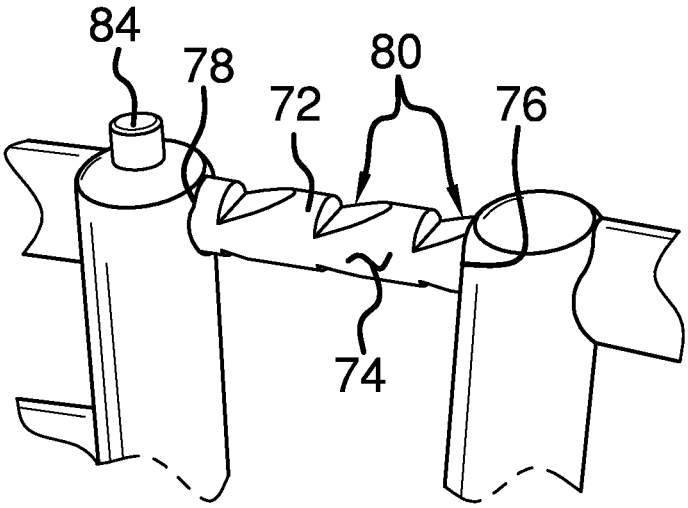
FIG. 5 is a perspective view of an embodiment of the disclosure.
Figure 6:
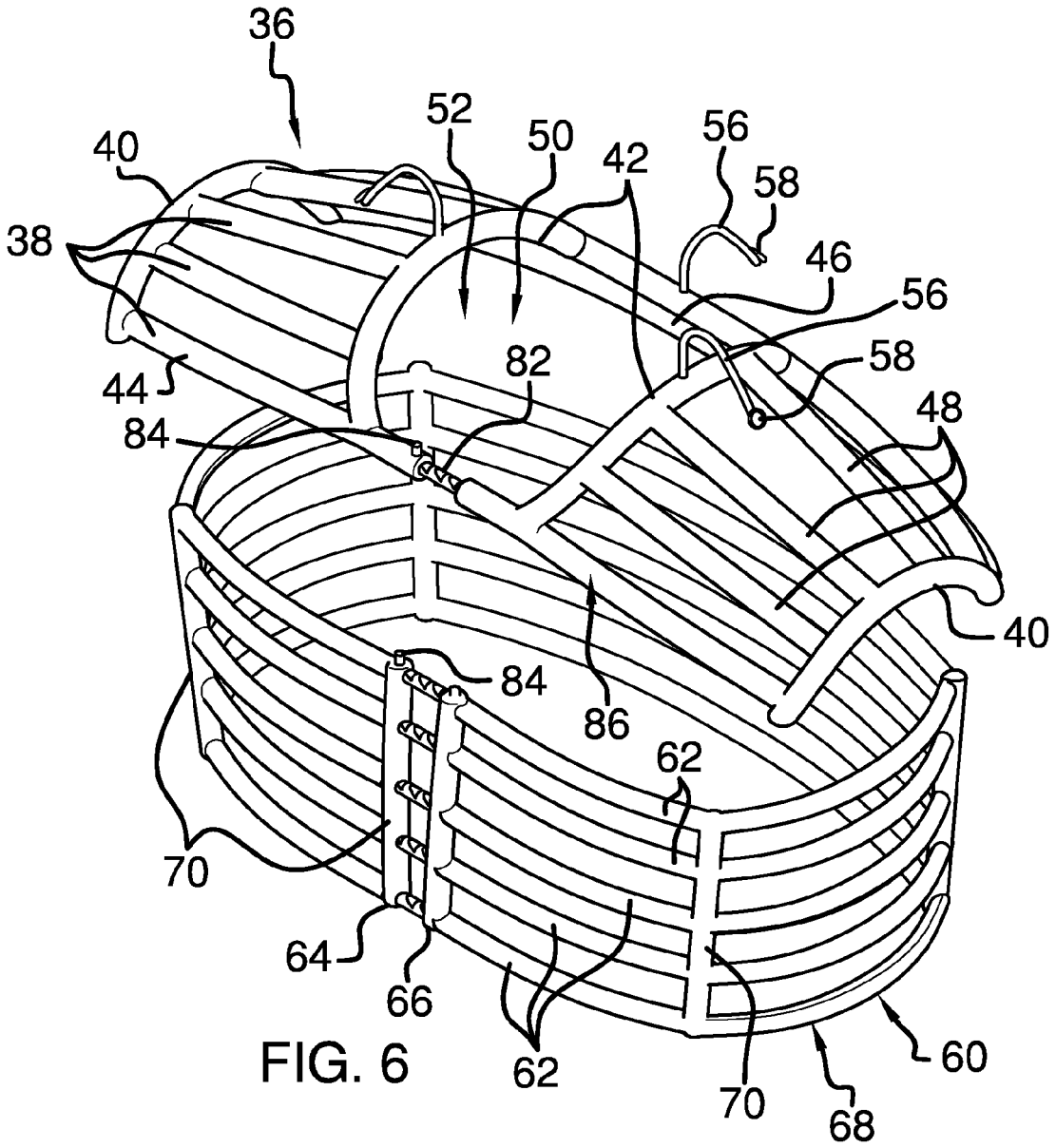
FIG. 6 is a top perspective view of an embodiment of the disclosure.

With reference now to the drawings, and in particular to FIGS. 1 through 6 thereof, a new protection device embodying the principles and concepts of an embodiment of the disclosure and generally designated by the reference numeral 10 will be described.

As best illustrated in FIGS. 1 through 6, the bodily protection assembly 10 generally comprises a pair of shoulder pads 12 structured to be worn by a user 14. The shoulder pads 12 include a torso portion 16 structured to be wrapped around the user's upper torso 18. A front side 20 of the torso portion 16 is split between a top edge 22 and a bottom edge 24 of the torso portion 16. The torso portion 16 is additionally structured so the top edge 22 of the torso portion 16 defines a neck opening 26. A pair of shoulder portions 28 of the shoulder pads 12 is coupled to and extends laterally away from an associated one of a first lateral side 30 and a second lateral side 32 of the torso portion 16. The shoulder portions 28 each covers an associated one of the user's shoulders 34.

A top cage 36 is provided. The top cage 36 comprises a plurality of longitudinal members 38 each coupled to and extending between a pair of end members 40 of the top cage 36. The longitudinal members 38 are evenly spaced apart along an entire length of the end members 40. Each of the end members 40 is curved such that the top cage 36 has a semi-cylindrical cross section taken perpendicular to a longitudinal axis extending through each of the end members 40.

The top cage 36 has a pair of medial members 42 each coupled between a front one 44 and a rear one 46 of the longitudinal members. Each of the remaining ones 48 of the longitudinal members terminates at each of the medial members 42. The medial members 42 are evenly spaced apart from a center 50 of the top cage 36 to define a neck opening 52 in the top cage 36. The user's head 54 is extendable through the neck opening 52 in the top cage 36.

The top cage 36 is coupled to the torso portion 16 of the shoulder pads 12 such that the top cage 36 is positioned within the shoulder pads 12. The neck opening 52 in the top cage 36 is aligned with the neck opening 26 in the torso portion 16 of the shoulder pads 12. The top cage 36 enhances the shoulder pads 12 and prevents impact energy from being transferred into the user's shoulders 34.

A plurality of tethers 56 is provided. Each of the tethers 56 is coupled and extends upwardly from the top cage 36 around the neck opening 52 in the top cage 36. Each of the tethers 56 extends through the neck opening 26 in the torso portion 16 of the shoulder pads 12. The free ends 58 of the tethers 56 may be engaged to a helmet worn by the user 14 to stabilize the helmet relative to the top cage 36 and the shoulder pads 12.

A lower cage 60 is provided. The lower cage 60 comprises a plurality of horizontal members 62 that each has a first end 64 and a second end 66. Each of the horizontal members 62 is curved between the first 64 and second 66 ends such that each of the horizontal members 62 forms an open loop 68. The lower cage 60 includes a plurality of vertical members 70 each intersecting and extending between each of the horizontal members 62 such that the horizontal members 62 are vertically spaced apart. The vertical members 70 are evenly spaced apart and distributed between the first 64 and second 66 ends of each of the horizontal members 62.

The lower cage 60 is embedded within the shoulder pads 12 such that the lower cage 60 is positioned around the user's upper torso 18 when the shoulder pads 12 are worn by the user 14. The lower cage 60 surrounds the user's upper torso 18. Thus, the lower cage 60 may prevent impact energy from being transferred into the user's upper torso 18.

A plurality of locks 72 each has an outer surface 74 extending between a fixed end 76 and a distal end 78 of the locks 72. The outer surface 74 of each of the locks 72 has a plurality of grooves 80 extending inwardly therein. The grooves 80 are evenly spaced apart and distributed between the fixed 76 and distal 78 ends of the locks 72.

The fixed end 76 of the locks 72 is coupled to the first end 64 of an associated one of each of the horizontal members 62 of the lower cage 60. The distal end 78 of each of the locks 72 engages the second end 66 of the associated one of the horizontal members 62 such that the lower cage 60 is retained in a closed position. The front longitudinal member 44 of the top cage 36 is split at the neck opening 52 in the top cage 36 such that the front longitudinal member 44 defines an open ring 86. The fixed end 76 of an upper one of the locks 82 extends across the split in the front longitudinal member 44.

A plurality of retainers 84 is each movably coupled to an associated one of each of the horizontal members 62 and the front longitudinal member 44. Each of the retainers 84 engages a selected one of the grooves 80 in an associated one of the locks 72. The retainers 84 allow the top 36 and lower 60 cages to be tightened around the user 14. The retainers 84 are depressed by the user 14 to release the locks 72.

In use, the assembly 10 is worn when the user 14 engages in an athletic activity involving physical impact. The top 36 and lower 60 cages protect the user's skeleton from impact injury. The top 36 and lower 60 cages provide an additional layer of impact protection with respect to the shoulder pads 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A bodily protection assembly comprising:

a pair of shoulder pads structured to be worn by a user;

a top cage coupled to said shoulder pads such that said top cage is positioned within said shoulder pads wherein said top cage is configured to prevent impact energy from being transferred into the user's shoulders, said top cage comprising a plurality of longitudinal members each coupled to and extending between a pair of end members of said top cage, said longitudinal members being evenly spaced apart along an entire length of said end members, each of said end members being curved such that said top cage has a semi-cylindrical cross section taken perpendicular to a longitudinal axis extending through each of said end members, said top cage having a pair of medial members being coupled between a front one and a rear one of said longitudinal members such that each of the remaining ones of said longitudinal members terminates at each of said medial members, said medial members being evenly spaced apart from a center of said top cage to define a neck opening in said top cage wherein a user's head is extended through said neck opening;

a lower cage coupled to said shoulder pads such that said lower cage is positioned within said shoulder pads such that said lower cage is configured to surround the user's upper torso wherein said lower cage is configured to prevent impact energy from being transferred into the user's upper torso.

2. The assembly according to claim 1, further comprising said lower cage comprising a plurality of horizontal members each having a first end and a second end, each of said horizontal members being curved between said first and second ends such that each of said horizontal members forms an open loop.

3. The assembly according to claim 2, further comprising said lower cage including a plurality of vertical members each intersecting and extending between each of said horizontal members such that said horizontal members are vertically spaced apart, said vertical members being evenly spaced apart and distributed between said first and second ends of each of said horizontal members.

4. A bodily protection assembly comprising:

a pair of shoulder pads structured to be worn by a user;

a top cage coupled to said shoulder pads such that said top cage is positioned within said shoulder pads wherein said top cage is configured to prevent impact energy from being transferred into the user's shoulders;

a lower cage coupled to said shoulder pads such that said lower cage is positioned within said shoulder pads such that said lower cage is configured to surround the user's upper torso wherein said lower cage is configured to prevent impact energy from being transferred into the user's upper torso, said lower cage comprising a plurality of horizontal members each having a first end and a second end, each of said horizontal members being curved between said first and second ends such that each of said horizontal members forms an open loop, said lower cage including a plurality of vertical members each intersecting and extending between each of said horizontal members such that said horizontal members are vertically spaced apart, said vertical members being evenly spaced apart and distributed between said first and second ends of each of said horizontal members; and a plurality of locks each having an outer surface extending between a fixed end and a distal end of said locks, said fixed end of said locks being coupled to said first end of an associated one of said horizontal members.

5. The assembly according to claim 4, further comprising said distal end of each of said locks engaging said second end of said associated one of said horizontal members such that said top cage is retained in a closed position.

6. A bodily protection assembly comprising:

a pair of shoulder pads configured to be worn by a user;

a top cage, said top cage comprising a plurality of longitudinal members each coupled to and extending between a pair of end members of said top cage, said longitudinal members being evenly spaced apart along an entire length of said end members, each of said end members being curved such that said top cage has a semi-cylindrical cross section taken perpendicular to a longitudinal axis extending through each of said end members;

said top cage having a pair of medial members being coupled between a front one and a rear one of said longitudinal members such that each of the remaining ones of said longitudinal members terminates at each of said medial members, said medial members being evenly spaced apart from a center of said top cage to define a neck opening in said top cage wherein a user's head is extendable through said neck opening;

said top cage being coupled to said shoulder pads such that said top cage is positioned within said shoulder pads wherein said top cage is configured to prevent impact energy from being transferred into the user's shoulders; and a lower cage, said lower cage comprising a plurality of horizontal members each having a first end and a second end, each of said horizontal members being curved between said first and second ends such that each of said horizontal members forms an open loop;

said lower cage including a plurality of vertical members each intersecting and extending between each of said horizontal members such that said horizontal members are vertically spaced apart, said vertical members being evenly spaced apart and distributed between said first and second ends of each of said horizontal members;

said lower cage being coupled to said shoulder pads such that said lower cage is positioned within said shoulder pads such that said lower cage is configured to surround the user's upper torso wherein said lower cage is configured to prevent impact energy from being transferred into the user's upper torso; and a plurality of locks each having an outer surface extending between a fixed end and a distal end of said locks, said fixed end of said locks being coupled to said first end of an associated one of said horizontal members, said distal end of each of said locks engaging said second end of said associated one of said horizontal members such that said top cage is retained in a closed position.

* * * * *